United States Patent [19]

Braatz

[11] 4,114,412

[45] Sep. 19, 1978

[54] TUMBLER LOCK ALARM CONSTRUCTION

[76] Inventor: Willi Braatz, 8885 Appleknoll La., Cincinnati, Ohio 45236

[21] Appl. No.: 771,536

[22] Filed: Feb. 24, 1977

[51] Int. Cl.[2] ..... E05B 17/00

[52] U.S. Cl. ..... 70/441; 70/DIG. 49; 70/DIG. 50

[58] Field of Search ..... 70/266–274, 70/416, 419, 444, DIG. 49, DIG. 50; 340/274; 200/44, 61.66; 70/431, 441, 432

[56] References Cited

U.S. PATENT DOCUMENTS

| | | | |
|---|---|---|---|
| 2,318,908 | 5/1943 | Welch | 70/419 |
| 3,587,081 | 6/1971 | Hawkins | 70/268 |
| 3,878,700 | 4/1975 | Lopez | 70/419 |

*Primary Examiner*—Robert L. Wolfe
*Attorney, Agent, or Firm*—Walter S. Murray

[57] ABSTRACT

The invention provides a tamper-proof pin tumbler lock construction cooperative with an alarm means and protective against unauthorized picking or core drilling activities on the lock while securing normal key opening and closing procecures therefor. The construction energizes an alarm if the unauthorized activities exceed a predetermined time limit required for normal key opening and closing procedures.

5 Claims, 2 Drawing Figures

TUMBLER LOCK ALARM CONSTRUCTION

SUMMARY OF THE INVENTION

This invention relates generally to improvements in barrel lock alarms and is specifically directed to a tamper-proof pin tumbler lock construction cooperative with an alarm means to be effective against unauthorized picking or drilling activities on the protected lock while providing for normal key operated opening and closing procedures therefor.

An object of the invention is to provide a pin tumbler lock construction that is virtually impossible to pick or core drill in that when such unauthorized actions are taken the lock construction engages an alarm, and preferably a barrel locking device, in the predetermined time of substantially 10 seconds, the construction also providing authorized opening and closing of the lock by a key within that 10 second period.

Another object of the invention is to provide a lock construction having the foregoing characteristics that is compact and reliable and may be mounted in a relatively small space such as that provided in vending machine closures, and the like.

These and other objects will become apparent to the reader upon reading the following description of the preferred embodiment of the invention in conjunction with the accompanying drawings wherein:

DESCRIPTION OF THE PREFERRED EMBODIMENT

Figure 1:
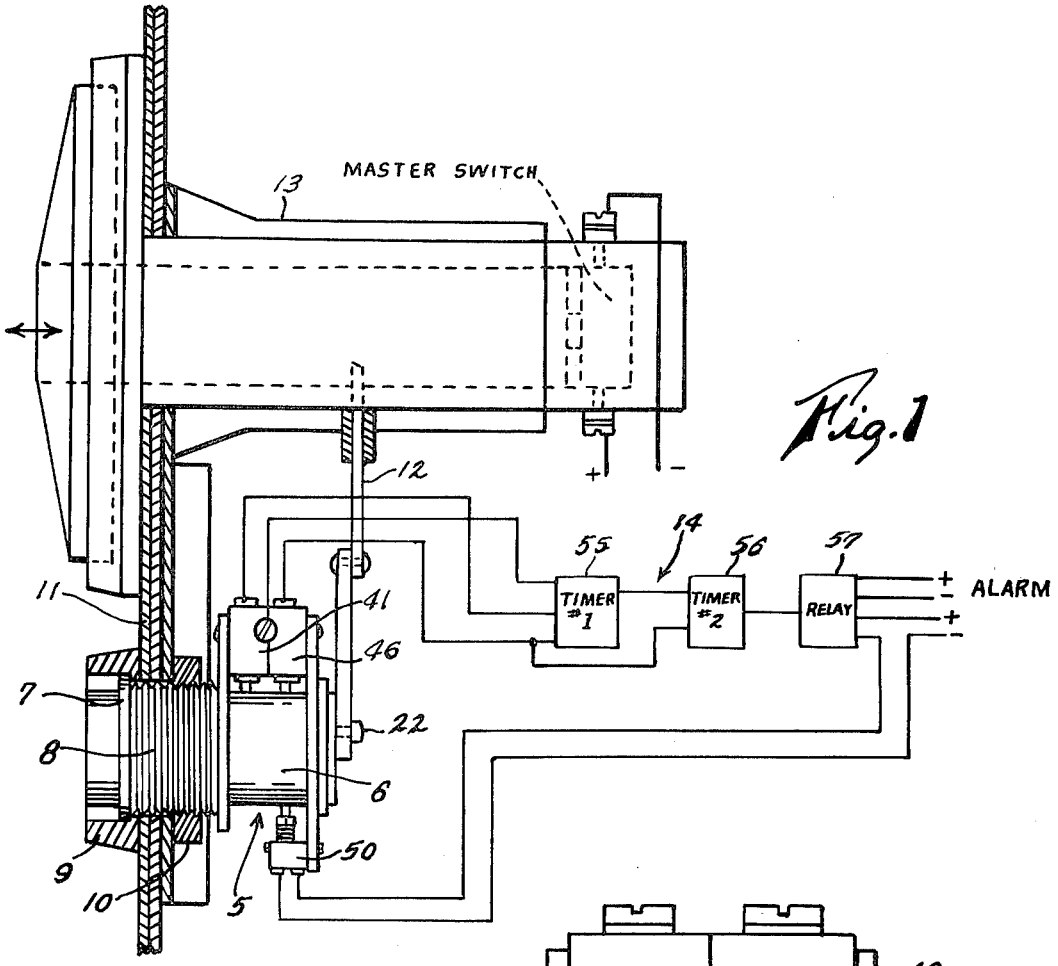
FIG. 1 is a side elevational view of the lock alarm construction of this invention depicted in a typical environment in conjunction with a preferable wiring diagram; parts being shown in central section.

Referring to FIG. 1 of the drawings the numeral 5 indicates a lock arrangement, commonly referred to as a pin tumbler lock, and comprising a cylindrical case 6 having a circular flange 7 and external threads 8 around its forward end which cooperate with a ring 9 and a nut 10 to mount the lock case 6 to a closure 11, or other suitable member. The lock mechanism preferably controls the protraction and retraction of a bolt operating linkage 12 which in turn latches and releases, respectively, an otherwise unguarded and conventional master switch device 13 for electric circuits such as residence and commercial building burglar alarm systems. The preferred utility of the lock mechanism 5 is illustrated in conjunction with a conventional electrical system 14 to preclude unauthorized picking and/or drilling of the lock mechanism and could also be associated with vending machine closures, or the like. Such unauthorized tampering with the lock would effect the sounding of an alarm and/or maintaining the lock construction in its inoperative, locked condition.

Figure 2:
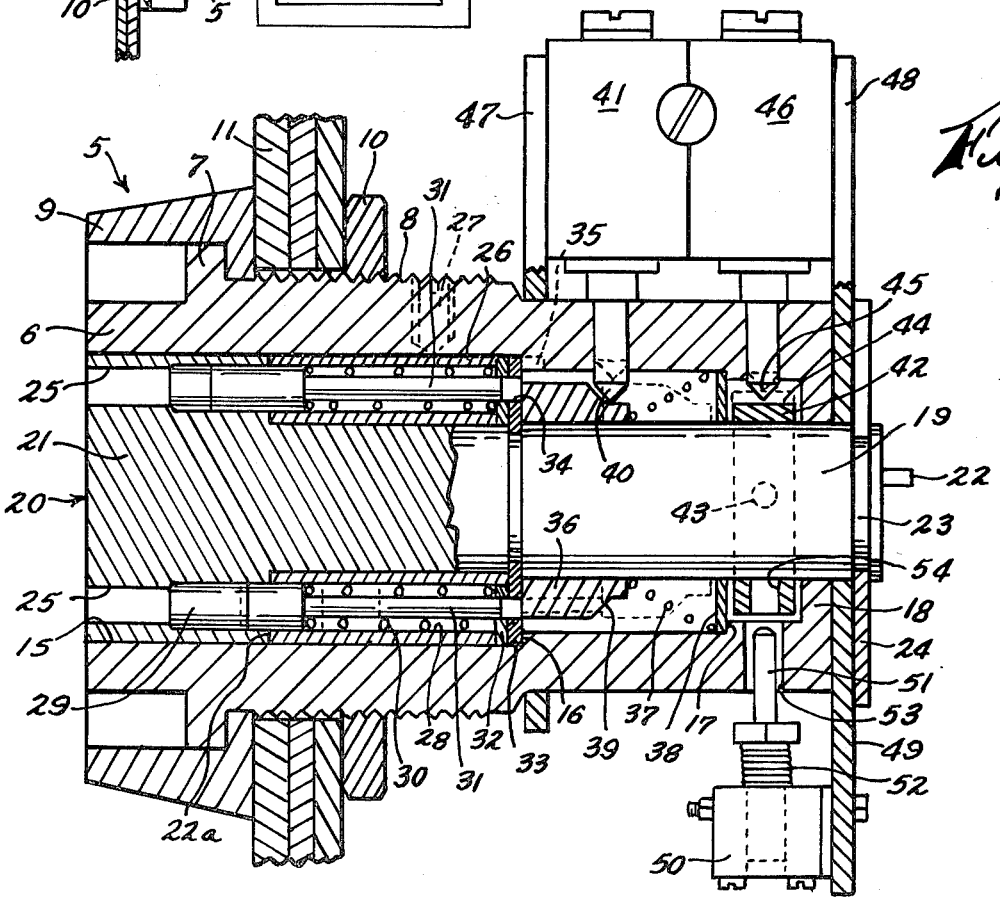
FIG. 2 is a greatly enlarged, longitudinal sectional view through the lock construction illustrated in FIG. 1, cooperative parts being shown in side elevation.

With particular reference to FIG. 2 of the drawings the cylindrical case 6 has a three diameter bore 15 formed concentrically therethrough to provide a forwardly facing progression of shoulders 16, 17 and 18; the rearmost shoulder 18 being radially restricted to provide a journal for the small cylindrical portion 19 of a two diameter barrel 20. The larger portion 21 of said barrel is journalled in the larger, forward diameter of the bore 15. The two diameter form of the barrel provides a rearwardly facing shoulder **22*a*. The portion 19 of the barrel extends rearwardly beyond the shoulder 18 of the case, and has an eccentric pin 22 thereon to operate the linkage 12, or other suitable members, the extended end being provided with a peripheral groove 23 to receive a spring fastener 24** which snaps into the groove to maintain the barrel against axial displacement within the case.

A circular row of angular spaced apart through holes 25 are formed in the forward end 21 of the barrel 20, said holes having their respective axes parallel to the axis of the barrel and extending between the forward face and the shoulder **22*a* of said barrel. A sleeve 26 is rotatable on the barrel and is fixedly mounted against rotation in the case by a set screw 27, the sleeve being provided with through holes 28 normally in alignment with the row of holes 25 in the barrel. The barrel 21 is normally held in locked position within the case by axially moveable pairs of pin tumblers 29 disposed in the holes 25 and 28 and urged forwardly be expansile springs 30. Freeing of the barrel 20 to open or close the lock is accomplished by full insertion of the usual key into the holes 25 in the barrel which brings the abutting faces of all the pairs of tumbler pins 29 into the shear plane of the lock, indicated by reference numeral 22*a*, enabling the key to rotate the barrel 90° to actuate the eccentric 22**.

TAMPER SENSING FEATURES OF THE LOCK

The rearmost tumbler of each pair 29 of tumbler pins is provided with an extended portion 31 which is supported by the inner surface of the spring 30, a backup washer 32 and a brass ring 33; the latter having bearing holes 34 therein through which the extended pin portion 31 is axially moveable. The ring 33 is positioned against the shoulder 16 and is secured against rotation within the housing by a lip 35 on the ring seated in a cavity in the interior case wall.

A pick sensing means for the lock comprises a ring shaped cam 36 mounted for axial movement on portion 19 of the barrel 20 and biased by a conical, expansile spring 37 toward the forward end of the lock. The spring bears against the cam 36 and against a washer 38 positioned against the shoulder 17 of the case. An inclined, circumferential camming surface 39 is formed on the rear portion of the cam 36 which engages the tapered end portion 40 of the operating pin of an off-on microswitch 41.

A rotatable ring-shaped cam 42 is positioned within the case and is fixed to the rearward part of the barrel portion 19 by means of a set screw 43; the eccentric peripheral side of the cam 42 engaging the tapered end portion 45 of the operating pin of an off-on microswitch 46. The microswitches 41 and 46 are mounted on the lock case 6 by a bracket member 47 secured to the switch 41 and embracing the case and by a bracket 48 which is secured to the switch 46 and has a hole therein through which the end of the barrel portion 19 freely passes.

EMERGENCY BARREL LOCK FEATURE

The bracket 48 is provided with a depending portion 49 which mounts a solenoid 50 adapted to operate a stop pin 51 normally held in retracted position by a contractile spring 52. The pin is normally disposed in a bore 53 in the case 6 which is in alignement with a hole 54 formed in the cam 42. When emergency conditions require, the solenoid 50 is energized to move the pin 51 into the hole 54 in the cam to preclude rotation of the lock barrel 20, as will be more fully understood hereinafter.

OPERATION

The operation of my pin tumbler lock alarm construction, described in detail heretofore, will now be detailed in conjunction with the electrical system 14 shown diagramatically in FIG. 1 of the drawings and wherein the numeral 55 indicates a first timer set to be activated for a short time interval of substantially 5 to 10 seconds which is thought to provide sufficient time to normally open or close the pin tumbler lock 5 with an authorized key prior to the energization of a second timer 56 set to energize an alarm system and the barrel lock 50 for a longtime interval approximately 5 to 10 minutes through a suitable relay 57.

In normal operation a suitable key is inserted into all the holes 25 in the barrel 20 bringing the pairs of tumbler pins 29 into the shear line 22*a* of the lock thus releasing the barrel for key operated rotation of the barrel to actuate the eccentric 22 and the master switch linkage 12. At the same time as the pin tumblers are being initially moved towards their shear line positions by the key the extension 31 on a leading pin tumbler will engage and axially move the sensing cam 36 against the bias of the spring 37, such initial cam movement instantly closing microswitch 41 to energize the timer 55. As the barrel is rotated to its lock open position within the elapsed time of 5 to 10 seconds the rotatable cam 42 will close microswitch 46 which interrupts the operation of the timer 55 and resets the circuits to normal conditions.

Now when the lock 5 is picked or drilled by an unauthorized person the slightest axial movement of any one of the pin tumblers 29 will cause its extension 31 to axially move the cam 36 which in turn closes the microswitch 41 to energize timer 55. As the elapsed lock tampering time exceeds the 5 to 10 seconds, the barrel will remain in normal lock closed condition, the timer 55 will energize timer 56 which in turn energizes the alarm system and the blockout solenoid 50 for a substantially long period of time. As the short interval of time was not sufficient to rotate the barrel by such unauthorized tampering the solenoid will maintain its lock pin 51 within the hole 53 in the barrel to lock the barrel against rotation during the alarm period.

It will therefore be understood that I have provided a lock alarm construction capable of normal operation by an authorized key and which senses the initial endeavor by unauthorized persons to pick the tumbler pins or drill out the barrel to actuate an alarm system and also lock the barrel in its normal closed position during the alarm period. These lock features are contained within a relatively small, compact construction that is an integral part of the lock, thus affording a tamper-proof lock that may be mounted within limited spaces now provided for conventional locks.

What is claimed is:

1. In a tumbler lock alarm construction the combination of a lock case, a barrel rotatable in the case, tumblers movable in the case and the barrel, a lock tampering sensor responsive to the initial axial movement of any one of the tumblers, a time delay means energized by the sensor and set to provide a normal predetermined time limit for authorized operation of the lock, means responsive to the full rotation of the barrel adapted to deenergize the time delay means, and an alarm means triggered by the time delay means after the lapse of the set predetermined time limit of said time delay means.

2. In a tumbler lock alarm construction the combination of a case, a barrel rotatable in the case, tumblers axially movable in the barrel and in the case parallel to the axis of the barrel, a lock tampering sensor responsive to the initial axial movement of at least one of the tumbler pins, a time delay means connected to the sensor and set to provide a normal predetermined time limit for authorized rotational movement of the lock barrel, means responsive to the full rotation of the barrel adapted to deenergize the time delay means, and an alarm means triggered by the time delay means after the lapse of the set predetermined time limit of said time delay means.

3. In a tumbler lock alarm construction as set forth in claim 2 wherein the lock tampering sensor is axially moveable on the rear portion of the barrel, and each pin tumbler has an extension mounted thereon projecting rearwardly into normal operative, spaced relation with the sensor.

4. In a tumbler lock alarm construction as set forth in claim 3 wherein the lock tampering sensor is a switch actuating cam ring baised toward the pin tumblers, and the means responsive to the full rotation of the barrel is an eccentric ring cam fixed on the end portion of the barrel.

5. In a tumbler lock alarm construction as set forth in claim 4 wherein a barrel blocking device is mounted on the base and locks the eccentric ring cam to the case when the alarm means is operative.

* * * * *